US009067657B2

(12) United States Patent
Hsu

(10) Patent No.: US 9,067,657 B2
(45) Date of Patent: Jun. 30, 2015

(54) UNFOLDED LIFE JACKET

(75) Inventor: Yung-Ho Hsu, Tainan (TW)

(73) Assignees: Yung-Ho Hsu, Tainan (TW); Liang Yi Development Design Co., Ltd., Tainan (TW)

( * ) Notice: Subject to any disclaimer, the term of this patent is extended or adjusted under 35 U.S.C. 154(b) by 0 days.

(21) Appl. No.: 14/122,492

(22) PCT Filed: Jul. 13, 2012

(86) PCT No.: PCT/CN2012/078587

§ 371 (c)(1), (2), (4) Date: Nov. 26, 2013

(87) PCT Pub. No.: WO2013/010454

PCT Pub. Date: Jan. 24, 2013

(65) Prior Publication Data

US 2014/0087611 A1 Mar. 27, 2014

(30) Foreign Application Priority Data

Jul. 15, 2011 (CN) ..... 2011 2 0250764 U

(51) Int. Cl.
*B63C 9/08* (2006.01)
*B63C 9/11* (2006.01)
*B63C 9/115* (2006.01)

(52) U.S. Cl.
CPC .. *B63C 9/11* (2013.01); *B63C 9/115* (2013.01)

(58) Field of Classification Search
CPC ..... B63C 9/08; B63C 9/11; B63C 9/115; B63C 9/13; B63C 9/135
USPC ..... 441/80, 88, 89, 106, 107, 108, 111, 441/112, 113, 114, 115, 116, 117, 118, 119, 441/123, 125–127, 129
See application file for complete search history.

(56) References Cited

U.S. PATENT DOCUMENTS

| | | | | | |
|---|---|---|---|---|---|
| 3,181,183 | A | * | 5/1965 | Allen | 441/116 |
| 3,903,555 | A | * | 9/1975 | Busby | 441/116 |
| 3,956,786 | A | * | 5/1976 | O'Link | 441/112 |
| 4,038,713 | A | * | 8/1977 | O'Link | 441/112 |
| 4,871,338 | A | * | 10/1989 | Hoffman | 441/116 |
| 5,588,892 | A | * | 12/1996 | McMahon | 441/116 |
| D379,397 | S | * | 5/1997 | McMahon | D21/805 |

* cited by examiner

*Primary Examiner* — Daniel V Venne
(74) *Attorney, Agent, or Firm* — Rosenberg, Klein & Lee

(57) ABSTRACT

Disclosed in the present invention is an unfolded life jacket which comprises a fixed floating body provided with a notch through which a user's head passes; straps comprising interconnecting straps attached to the fixed floating body, the interconnecting straps being tied with intermeshing loop straps to hold the user's body; a movable floating body comprising a front movable floating block and a rear movable floating block, to which the fixed floating body is attached, respectively, a rope being attached to the front movable floating block and the rear movable floating block, the rope being tied with the intermeshing loop straps, an adhesion part limiting the front movable floating block and the rear movable floating block on the intermeshing loop straps. It helps the user to keep in a vertical state in water so as to stabilize the gravity center and keep the head out of the water surface.

12 Claims, 16 Drawing Sheets

UNFOLDED LIFE JACKET

FIELD OF THE INVENTION

The present invention relates to an unfolded life jacket, and more particularly, to an unfolded life jacket to keep a user maintain an upright pose in water.

BACKGROUND OF THE INVENTION

The conventional life vest provides a user a buoyancy force when in the water. However, if the user struggle when drop into the water, the conventional life vest cannot help the user to maintain an upright pose. Once the current is rapid, the user may be flipped into the water with his head merged into water and cannot be raised above water. Therefore, the conventional life vest cannot ensure that the user can maintain at upright pose and float, and potential danger exists.

Taiwan Publish No. M375039 discloses a life vest with a movable float board, which comprises a body having a first pivotable portion. The first pivotable portion is connected with a second pivotable portion of the movable float board. The body has a first connection portion, and the movable float board has a second connection portion which is located corresponding to the first connection portion. By the movable float board at the front and back of the user, the user can maintain a balanced upright pose with his core stable, such that the user's head is above water. However, the connections between parts of the life vest are complicated, and the life vest is malfunctioned easily when in use. Besides, the pivotable portions easily get dirty and hard to be cleaned, and therefore the use of the life vest is adversely affected.

Taiwan Publish No. M380300 discloses a balance life vest which has float board sewed to a body of the life vest. The body has a first connection portion and the float board has second connection portion which is located corresponding to the first connection portion. A flexible member is connected to the body and the float board.

However, because the flexible member is soft and flexible and is connected to the body directly, the float board pulls the flexible member will adversely affect the body so that the body is not stable when in water, or the flexible member is broken at the connection position with the body. Safety concern is obvious.

The life vest is not light so that it takes time for the user to wear and remove.

The life vest only uses the float board to provide force to keep the user float, the float force is not sufficient.

Although the life vest can keep the user at upright pose, it still needs to be improved for providing more safety.

SUMMARY OF THE INVENTION

The present invention relates to an unfolded life jacket, which comprises a fixed float having an opening. A fastening strip has a connection strip connected to the fixed float, and a securing strap is connected to the connection strip. A movable float has a front movable float and a back movable float, both of which are connected to the fixed float. The front movable float and the back movable float are connected to the securing strap by ropes. A plurality of attaching members are used to attach the front movable float and the back movable float to the securing strap.

Preferably, the unfolded life jacket further comprises a protective garment connected to the fixed float and having a zipper which extends to the opening, and the connection strip and the securing strap are disposed on the protective garment.

Preferably, the fixed float includes a front float and a back float. The opening is located on the front float. The front float is connected to the front movable float. The back float is connected to the back movable float.

Preferably, the front movable float includes a left float and a right float symmetrically located relative to the zipper. The left float and the right float are connected with the ropes.

Preferably, at least one of the ropes is made a turn around the securing strap.

The present invention also provides an unfolded life jacket, which comprises a protective vest and a fixed float which has an opening and is fixed to the protective vest. A movable float has a front movable float and a back movable float, both of which are connected to the protective vest. At least one securing strap wraps around the protective vest which has a front side and a back side, the front and back sides are connected to the front movable float and the back movable float, respectively, by ropes. The front movable float and the back movable float are unfoldable to horizontal positions which are their respective extreme unfolding positions.

Preferably, the protective vest has a plurality of loops which are horizontally aligned thereon. The at least one securing strap extends through the loops and wraps around the protective vest.

Preferably, at least one of the ropes is made a turn around the at least one securing strap.

Preferably, the protective vest has a plurality of attaching members for attaching the front movable float and the back movable float to the protective vest.

Preferably, the fixed float includes a front float and a back float. The opening is located on the front float. The front float is connected to the front movable float. The back float is connected to the back movable float.

The present invention further provides an unfolded life jacket, which comprises a side-wear protective garment having a side-opening. A fixed float has an opening and is fixed to the side-wear protective garment. A movable float includes a front movable float and a back movable float, both of which are connected to the side-wear protective garment. A securing strap wraps around the side-wear protective garment. A first connection member is disposed on one end of the securing strap, and a second connection member is disposed on the other end of the securing strap. The first connection member and the second connection member are adapted be joined to each other to enclose the side-opening. The front side and the back side of the side-wear protective garment are connected to the front movable float and the back movable float, respectively, by ropes. The front movable float and the back movable float are unfoldable to horizontal positions which are their extreme unfolding positions.

Preferably, the side-wear protective garment has a plurality of loops horizontally aligned thereon. The securing strap extends through the loops and wraps around the side-wear protective garment.

Preferably, a first end of the securing strap is fixed to the side-wear protective garment, and a second end of the securing strap is movable.

Preferably, the second connection member of the securing strap has a width larger than that of the loops, such that the second connection member of the securing strap is stopped by the loops.

Preferably, at least one of the ropes is made a turn around the securing strap.

Preferably, the side-wear protective garment has attaching members for attaching the front movable float and the back movable float to the side-wear protective garment.

Preferably, the fixed float includes a front float and a back float. The opening is located on the front float. The front float is connected to the front movable float. The back float is connected to the back movable float.

The ropes are directly disposed on the securing strap to provide firm connection force and keep the movable float steadily float in water, by this way, the unfolded life jacket has better safety feature.

The unfolded life jacket includes fewer parts and is easily cleaned and has longer life of use.

The life jacket is light in weight which allows the user to proceed different actions.

The life jacket can be easily worn and removed by the securing strap within a short period of time.

The present invention will become more obvious from the following description when taken in connection with the accompanying drawings which show, for purposes of illustration only, preferred embodiments of the present invention.

BRIEF DESCRIPTION OF THE DRAWINGS

FIG. 13 shows the unfolded life jacket in accordance with the further embodiment of the present invention in;

DETAILED DESCRIPTION OF THE PREFERRED EMBODIMENT

Figure 1:
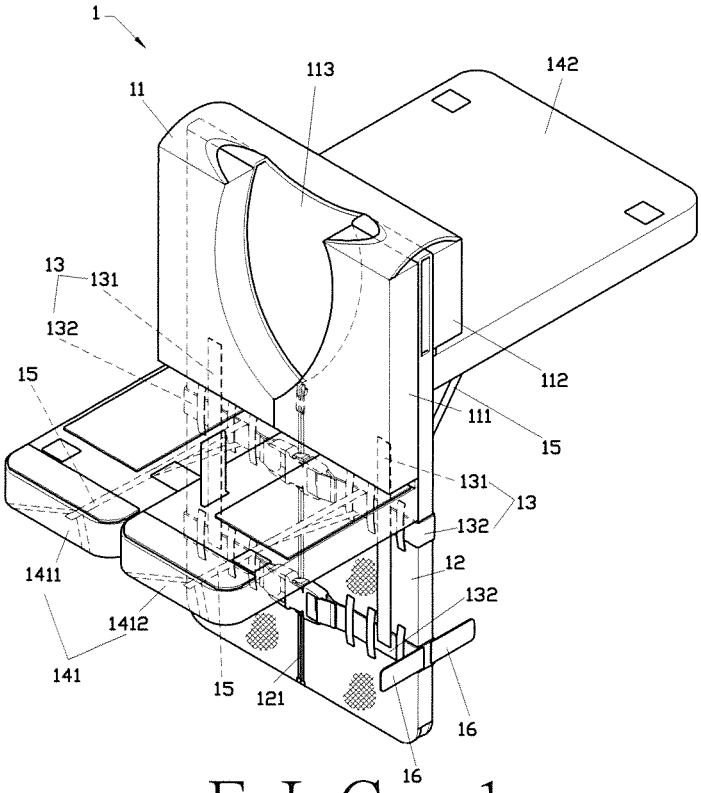
FIG. 1 is a perspective view to show an unfolded life jacket in accordance with a preferred embodiment of the present invention, wherein the front and back movable floats are unfolded.
Figure 2:
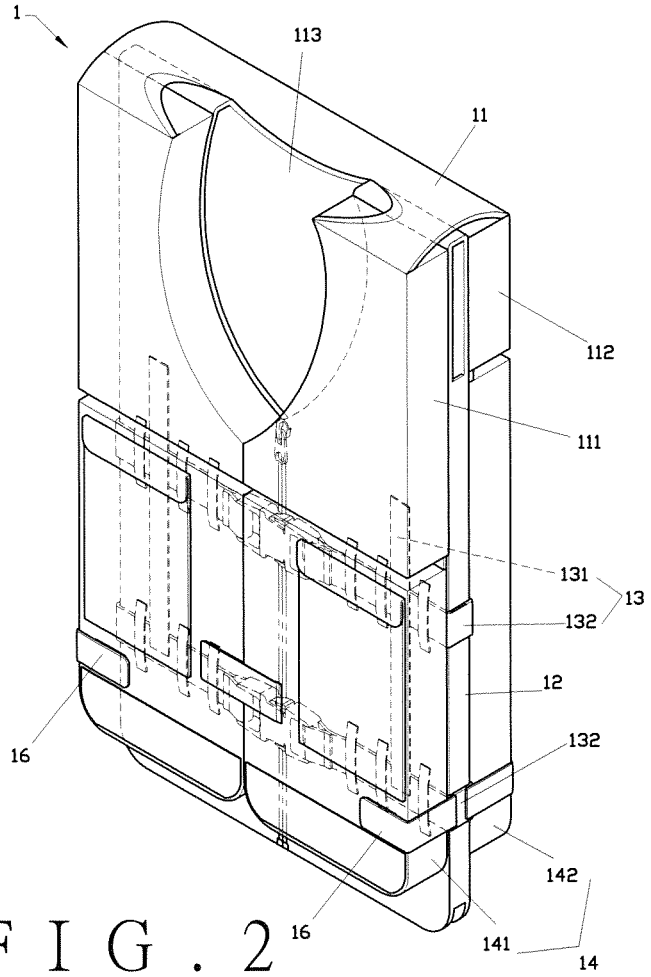
FIG. 2 is a perspective view to show the unfolded life jacket in accordance with the preferred embodiment of the present invention, wherein the front and back movable floats are not in unfolded poses.

FIG. 1 and FIG. 2 show an unfolded life jacket 1, which comprises a fixed float 11 including a front float 111 and a back float 112. The front float 111 has an opening 113. When a user's head extends through the opening 113, the fixed float 11 is rested on the shoulder of the user such that the chest of the user is protected by the front float 111, and the back of the user is protected by the back float 112. A protective garment 12 is connected to the fixed float 11 and has a zipper 121 extending to the opening 113. The user can easily put on or take off the unfolded life jacket 1 by using the zipper 121. A fastening strip 13 has a connection strip 131 connected to the fixed float 11, and the connection strip 131 is connected to a securing strap 132. The securing strap 132 is used to wrap around the user's body. The connection strip 131 and the securing strap 132 are disposed on the protective garment 12 and used to fix the protective garment 12 to the user's body which is then protected by the protective garment 12. A movable float 14 includes a front movable float 141 and a back movable float 142, wherein the front movable float 141 is connected to the front float 111, and the back movable float 142 is connected to the back float 112. Furthermore, the front movable float 141 includes a left float 1411 and a right float 1412, which are symmetrically located relative to the zipper 121. The left float 1411, the right float 1412 and the back movable float 142 are connected to the life jacket 1 by ropes 15. When the left float 1411, the right float 1412 and the back movable float 142 are unfolded by a buoyancy force in water, their unfolding angles are restricted by the ropes 15. Besides, the protective garment 12 has attaching members 16 (such as magnets, hook-and-loop fasteners or buttons) for attaching the left float 1411, the right float 1412 and the back movable float 142 to the securing strap 132.

Figure 3:
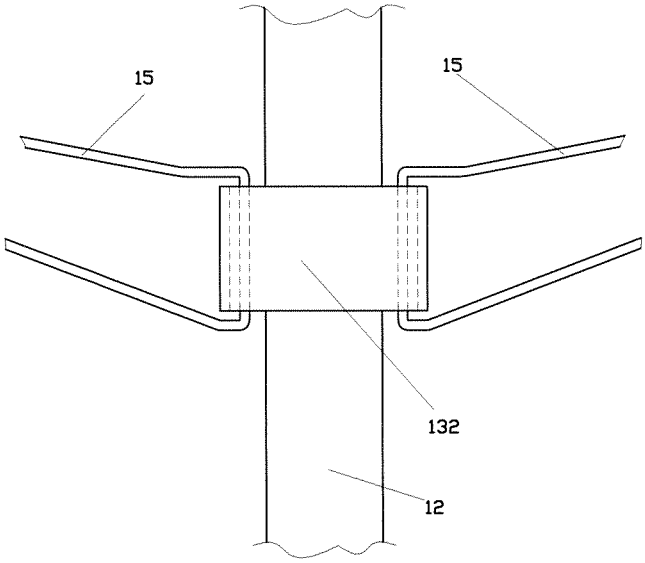
FIG. 3 shows the connection between the ropes and the securing strap in accordance with the preferred embodiment of the present invention.

Preferably, referring to FIG. 3, to prevent the ropes 15 being disconnected from the life jacket 1 by a significant impact force of water, each of the ropes 15 is made a turn around the securing strap 132 to be directly disposed on the securing strap 132, and therefore the ropes 15 can be firmly connected to the life jacket 1 and have higher resistance against the impact force of water, such that the reliability of the life jacket 1 is improved because the movable float 14 is tightly connected to the securing strap 132 by the ropes 15 and can steadily float in water.

Figure 4:
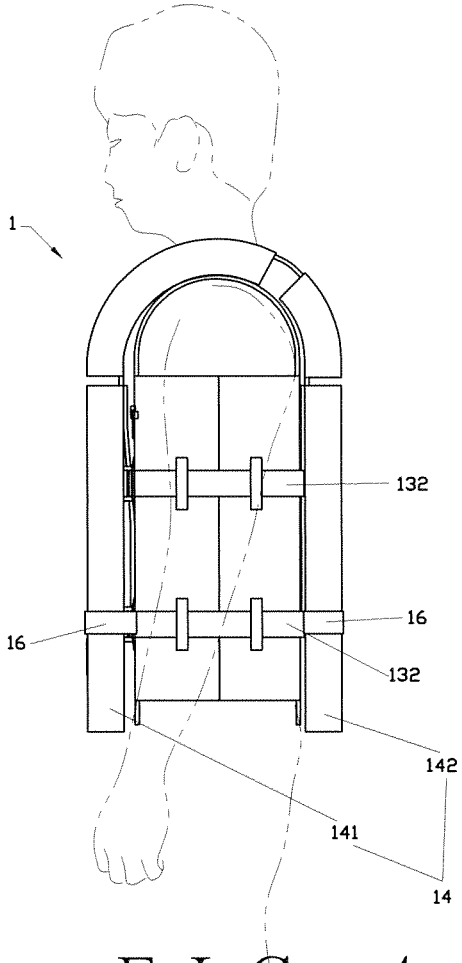
FIG. 4 shows that the unfolded life jacket in accordance with the preferred embodiment of the present invention is worn on a user.
Figure 5:
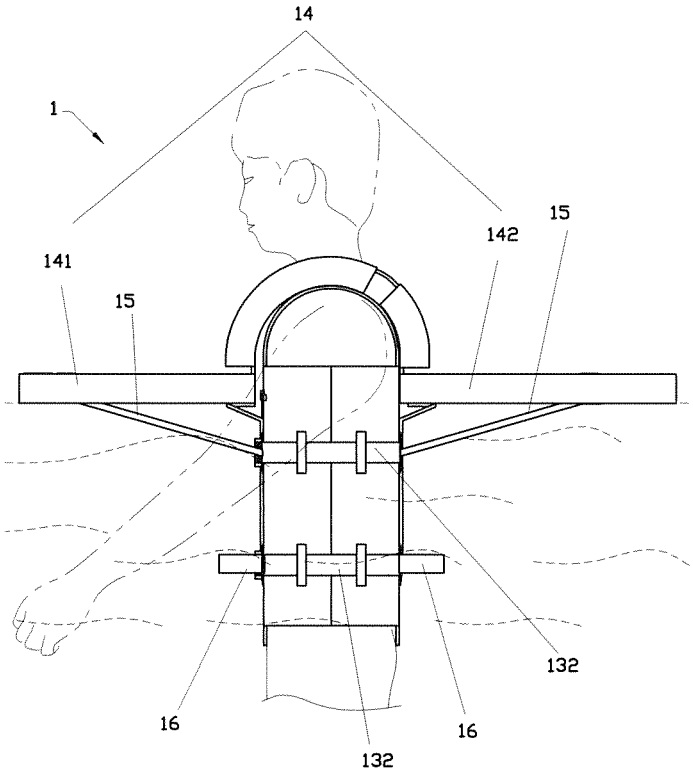
FIG. 5 shows that the unfolded life jacket in accordance with the preferred embodiment of the present invention is worn on a user and the front and back movable floats are unfolded.

FIG. 4 and FIG. 5 show the user wearing the life jacket 1. In general condition, the movable float 14 is attached to the securing strap 132 by the attaching members 16 to facilitate the user's movement. However, when the user is in water, the attaching members 16 are released to allow the movable float 14 to be unfolded within a unfolding angle range restricted by the ropes 15, such that the user can maintain an upright pose with his head above water and will not be flipped by the rapids; meanwhile, the movable float 14 is horizontally extended from the front and back of the user to prevent the user from being hit by objects, such that the user can safely float in water.

Figure 6:
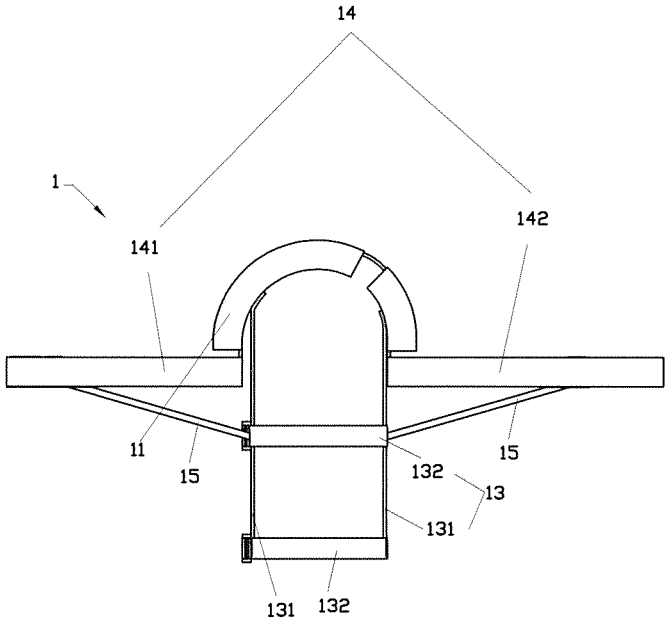
FIG. 6 shows an unfolded life jacket in accordance with another embodiment of the present invention.
Figure 7:
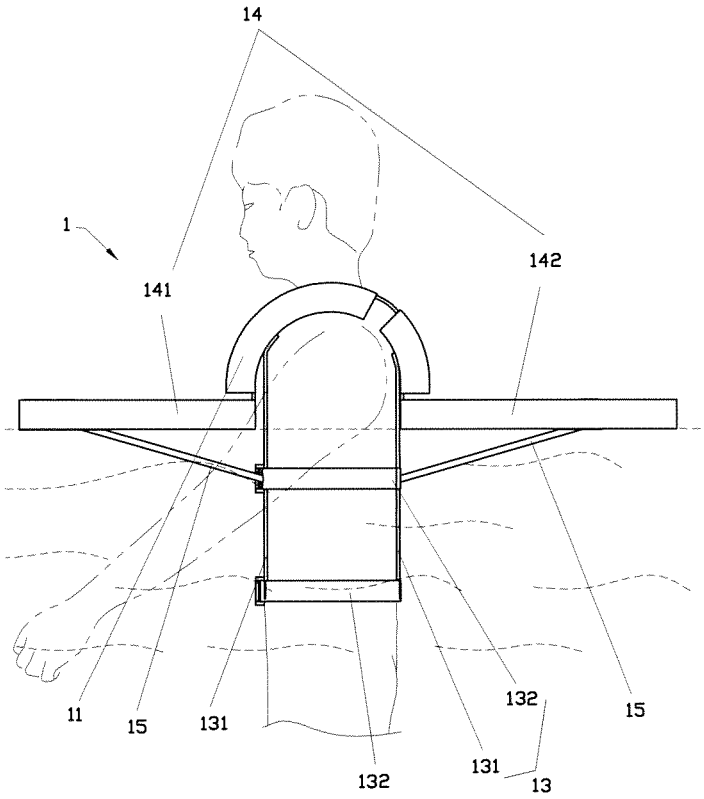
FIG. 7 shows that the unfolded life jacket in accordance with the another embodiment of the present invention is worn on a user and the front and back movable floats are unfolded.
Figure 8:
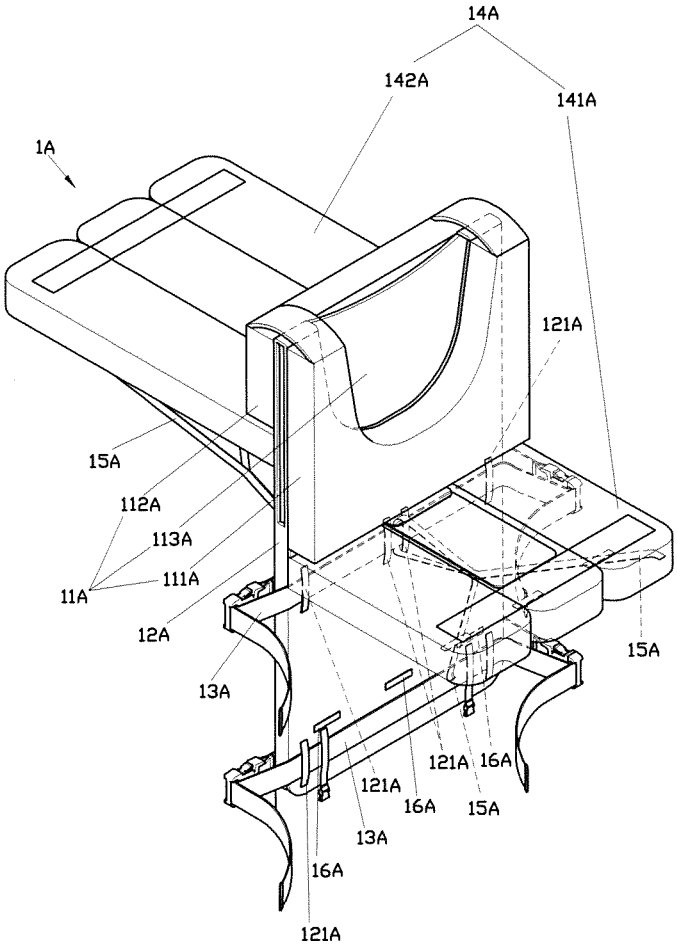
FIG. 8 shows an unfolded life jacket in accordance with yet another embodiment of the present invention.
Figure 9:
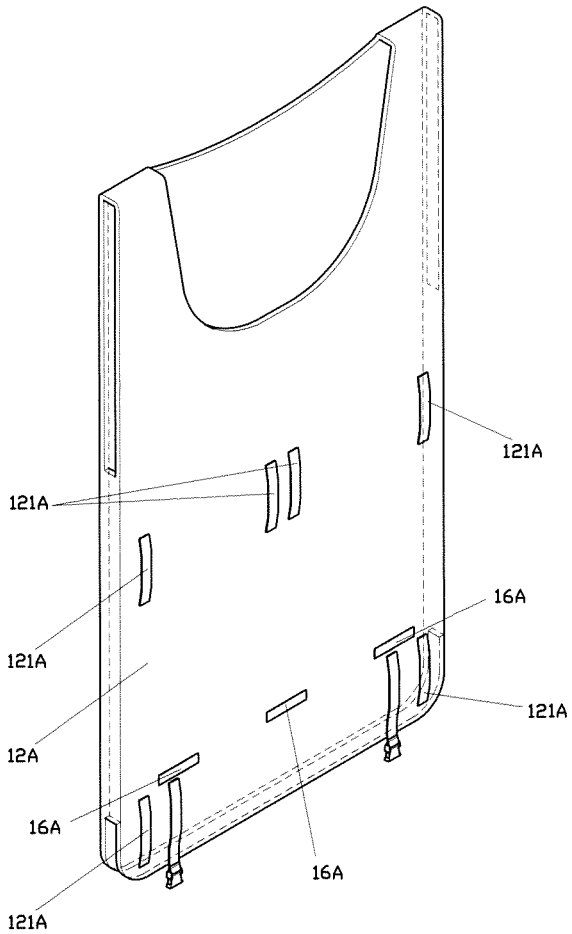
FIG. 9 shows the protective vest of the unfolded life jacket in accordance with the yet another embodiment of the present invention.
Figure 10:
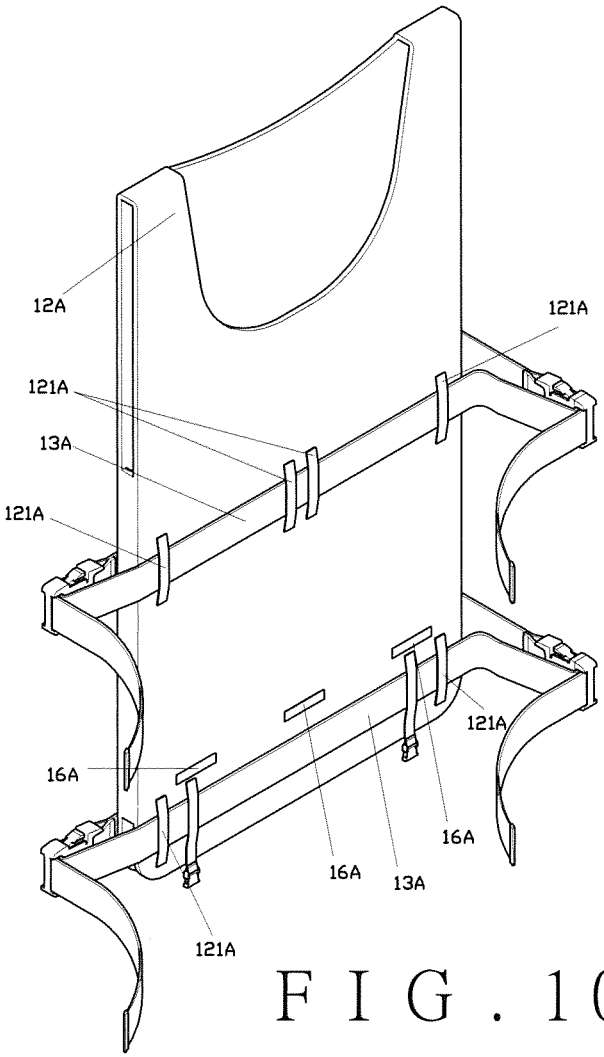
FIG. 10 shows that the securing strap wraps around the protective vest of the unfolded life jacket in accordance with the yet another embodiment of the present invention.
Figure 11:
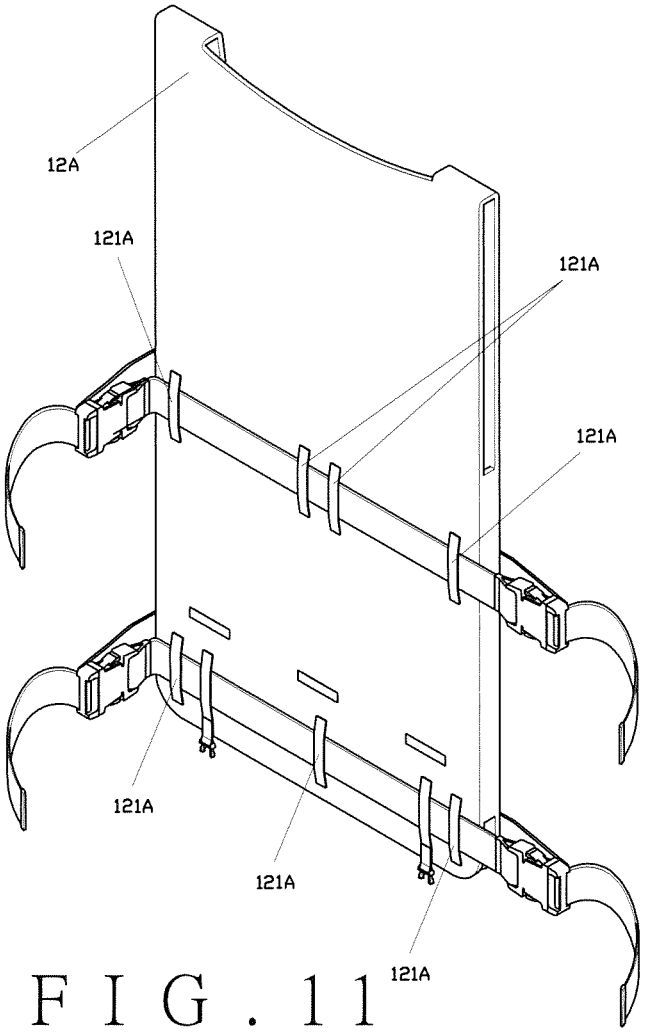
FIG. 11 shows the other side of the protective vest of the unfolded life jacket in FIG. 10.

FIGS. 6 and 7 show a variation of the life jacket 1. Wherein, the protective garment 12 is omitted, and the securing strap 132 directly wraps around the user's body to make the life jacket 1 lighter in weight and less complicated. This variation can also allow the user wearing the life jacket 1 to be safe in water and maintain the upright pose.

Figure 12:
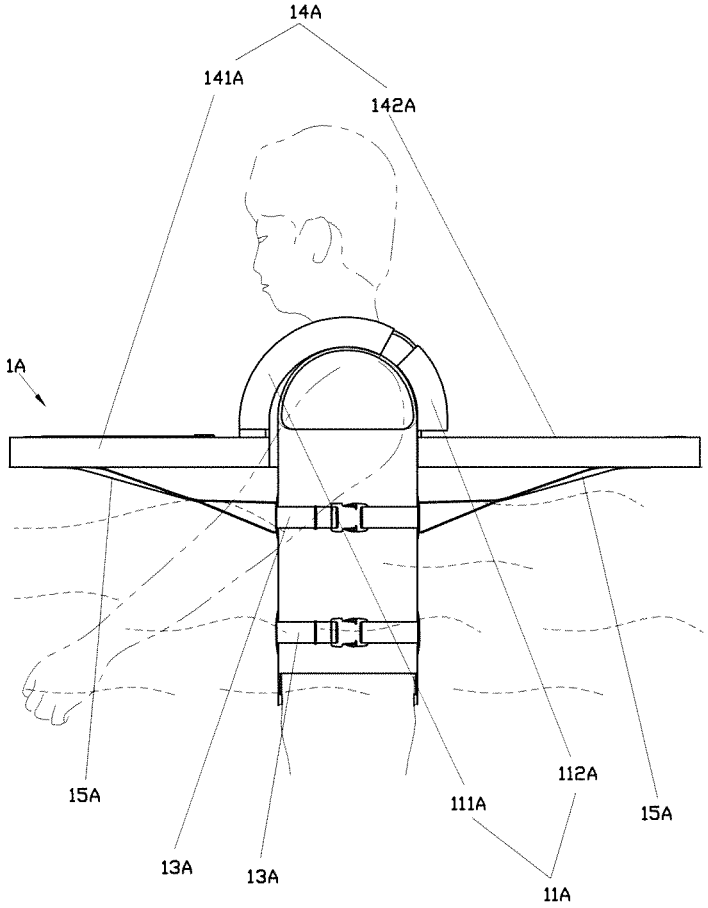
FIG. 12 shows an unfolded life jacket in accordance with a further embodiment of the present invention, wherein the front and back movable floats are unfolded in water.

FIGS. 8 to 12 show an unfolded life jacket 1A in accordance with another embodiment of the present invention. The life jacket 1A includes a protective vest 12A which can be easily put on or taken off. A fixed float 11A is fixed to the protective vest 12A and has a front float 111A, a back float 112A and an opening 113A, wherein a user's head can extend through the opening 113A to put on the life jacket 1A, and the fixed float 11A is then rested on the shoulder of the user such that the front float 111A protects the chest of the user and the back float 112A protects the back of the user. A movable float 14A includes a front movable float 141A and a back movable float 142A, which are both connected to the protective vest 12A. Wherein, the front movable float 141A and the back movable float 142A are connected to the front float 111A and the back float 112A, respectively. The protective vest 12A has a plurality of loops 121A horizontally aligned thereon. A securing strap 13A extends through the loops 121A to wrap around and be restricted to the protective vest 12A, such that the protective vest 12A be fixed to the user's body which is then protected by the protective vest 12. The tightness of the securing strap 13A is adjustable by an adjustment member disposed thereon. Alternatively, the securing strap 13A has a first end sewed to the protective vest 12A and a second end being movable, such that the tightness of the securing strap 13A can be easily adjusted when the user pulls the securing strap 13A, and the protective vest 12A can be more firmly fixed to the user's body. Furthermore, a front side and a back side of the protective vest 12A are connected to the front movable float 141A and the back movable float 142A, respectively, by ropes 15A. Wherein, at least one of the ropes 15A is made a turn around the securing strap 13A to be disposed on the securing strap 13A and to be Y-shaped, and the position where the at least one of the ropes 15A turning around the securing strap 13A is between two of the loops 121A such that the at least one of the ropes 15A is positioned between the two of the loops 121A. When the front movable float 141A and the back movable float 142A are unfolded by a buoyant force in water, their unfolding angles are restricted by the ropes 15A. The front movable float 141A and the back movable float 142A can be unfolded to horizontal positions which are their respective extreme unfolding positions as shown in FIG. 12. Besides, the protective vest 12A has attaching members 16A (such as magnets, hook and loop fasteners or buttons) for attaching the front movable float 141A and the back movable float 142A to the protective vest 12A.

Figure 13:
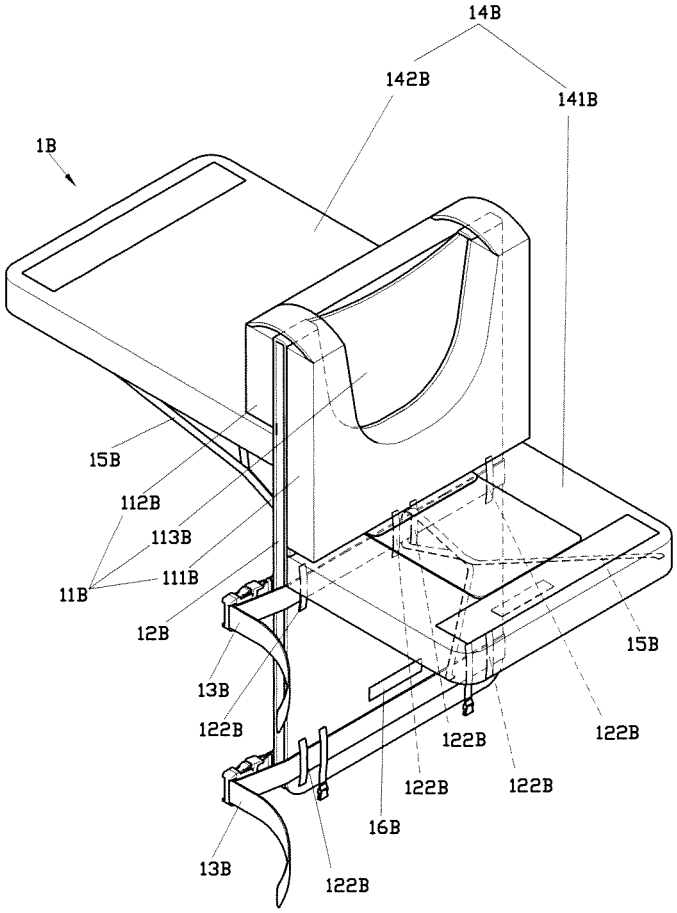
Figure 14:
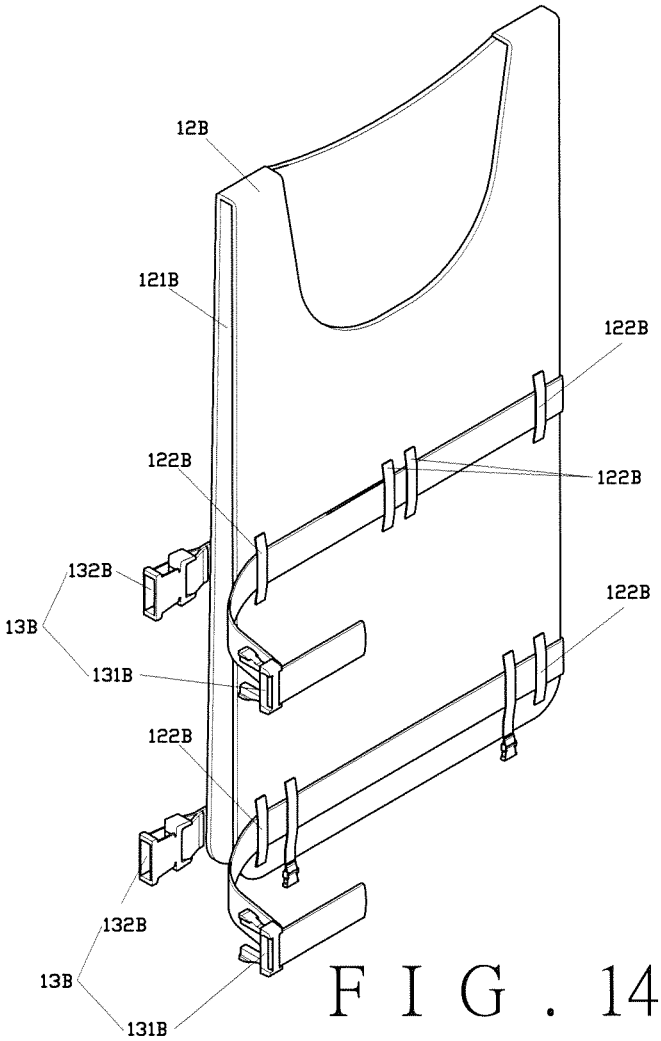
FIG. 14 is a perspective view to show a securing strap on a side-wear protective garment of the unfolded life jacket in accordance with the further embodiment of the present invention.
Figure 15:
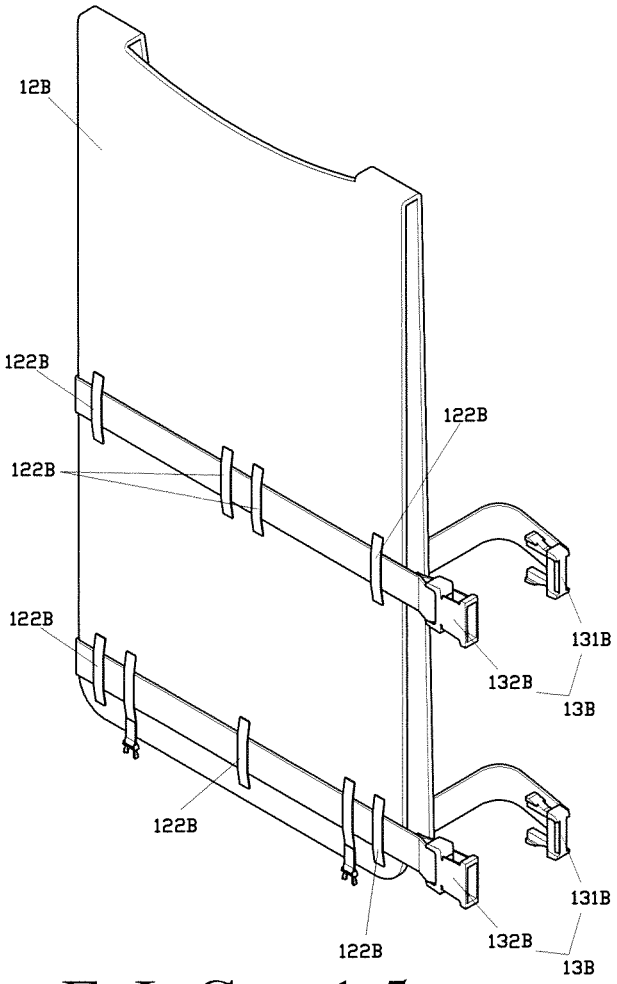
FIG. 15 is another perspective view to show the securing strap on the side-wear protective garment of the unfolded life jacket in FIG. 12.
Figure 16:
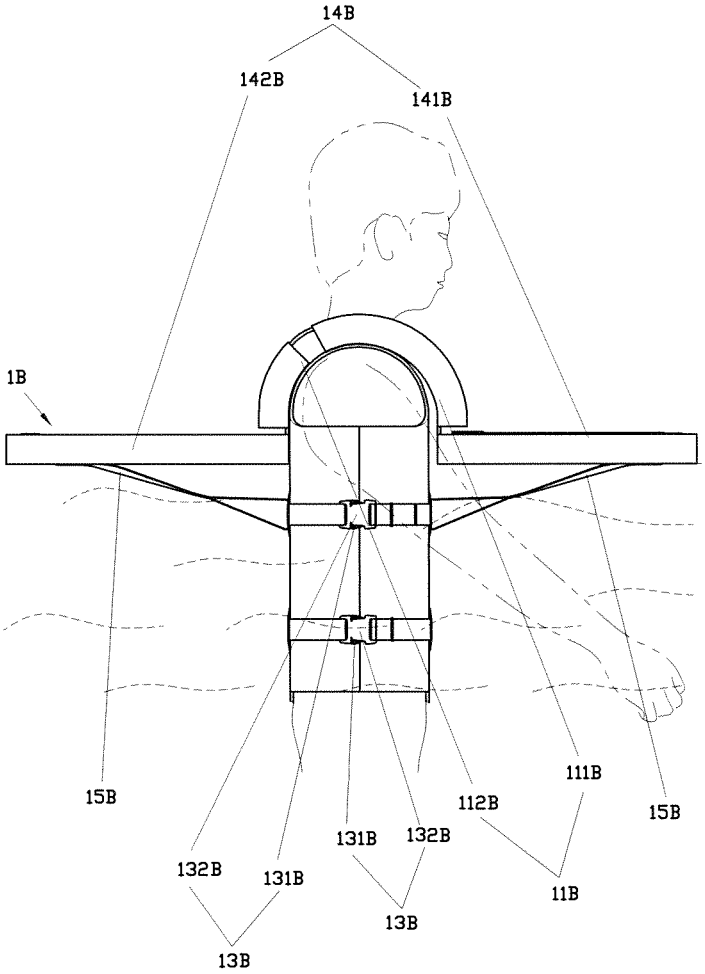
FIG. 16 shows that the unfolded life jacket in accordance with the further embodiment of the present invention in is worn on a user in water.

FIGS. 13 to 16 show an unfolded side-wear life jacket 1B in accordance with yet another embodiment of the present invention. The life jacket 1B comprises a side-wear protective garment 12B having a side-opening 121B. The side-wear protective garment 12B also comprises a plurality of loops 122B horizontally aligned thereon. A securing strap 13B extends through the loops 122B to wrap around and be restricted to the side-wear protective garment 12B. A first connection member 131B is disposed on one end of the securing strap 13B, and a second connection member 132B is disposed the other end of the securing strap 13B. The first connection member 131B and the second connection member 132B are used to be joined to each other. There are two ways to position the securing strap 13B; the first way is to fix the second connection member 132B by a part thereon which has a width larger than that of the securing strap 13B, such that the second connection member 132B is stopped and unable to freely move through the loops 122B; the second way is to sew and fix an end of the securing strap 13B on the side-wear protective garment 12B while to allow another end of the securing strap 13B to be movable. By the two ways as mentioned above, the securing strap 13B is positioned and fixed to the protective garment 12B, and a user can easily join the first connection member 131B and the second connection member 132B to each other. When using the life jacket 1B, the user can put on or take off the side-wear protective garment 12B via the side-opening 121B. Specifically, the first and second connection members 131B, 132B are joined to each other to enclose the side-opening 121B when the user is wearing the side-wear protective garment 12B; in contrast, the first and second connection members 131B, 132B are released from each other when the user is taking off the side-wear protective garment 12B. Therefore, the user can easily and quickly put on or take off the life jacket 1B. A fixed float 11B is fixed to the side-wear protective garment 12B and has a front float 111B, a back float 112B and an opening 113B. When the user's head extends through the opening 113B, the fixed float 11B is rested on the user's shoulder such that the front float 111B protects the user's chest and the back float 112B protects the user's back. A movable float 14B includes a front movable float 141B and a back movable float 142B, which are both connected to the side-wear protective garment 12B. Wherein, the front movable float 141B and the back movable float 142B are connected to the front float 111B and the back float 112B, respectively. A front side and a back side of the side-wear protective garment 12B are connected to the front movable float 141B and the back movable float 142B, respectively, by ropes 15B. Wherein, at least one of the ropes 15B is made a turn around the securing strap 13B to be disposed on the securing strap 13B and to be Y-shaped, and the position where the at least one of the ropes 15B turning around the securing strap 13B is between two of the loops 122B such that the at least one of the ropes 15B is positioned between the two of the loops 122B. When the front movable float 141B and the back movable float 142B float are unfolded by a buoyant force in water, their unfolding angles are restricted by the ropes 15B. The front movable float 141B and the back movable float 142B can be unfolded to horizontal positions which are their respective extreme unfolding position as shown in FIG. 13. Besides, the garment 12B has attaching members 16B (such as magnets, hook-and-loop fasteners or buttons) for attaching the front movable float 141B and the back movable float 142B to the side-wear protective garment 12B.

While we have shown and described the embodiment in accordance with the present invention, it should be clear to those skilled in the art that further embodiments may be made without departing from the scope of the present invention.

What is claimed is:

1. An unfolded life jacket, comprising:

a protective vest;

a fixed float having an opening and fixed to the protective vest;

a movable float including a front movable float and a back movable float, the front movable float and the back movable float both connected to the protective vest, and at least one securing strap wrapping around the protective vest, wherein a front side and a back side of the protective vest are connected to the front movable float and the back movable float, respectively, by ropes; and the front movable float and the back movable float are unfoldable to horizontal positions which are their respective extreme unfolding positions.

2. The unfolded life jacket as claimed in claim 1, wherein the protective vest has a plurality of loops horizontally aligned thereon, and the at least one securing strap extends through the loops and wraps around the protective vest.

3. The unfolded life jacket as claimed in claim 1, wherein at least one of the ropes is made a turn around the at least one securing strap.

4. The unfolded life jacket as claimed in claim 1, wherein the protective vest has a plurality of attaching members for attaching the front movable float and the back movable float to the protective vest.

5. The unfolded life jacket as claimed in claim 1, wherein the fixed float includes a front float and a back float, the opening is located on the front float, and front float and the back float are connected to the front movable float and the back movable float, respectively.

6. An unfolded life jacket, comprising:

a side-wear protective garment having a side-opening;

a fixed float having an opening, the fixed float fixed to the side-wear protective garment;

a movable float including a front movable float and a back movable float, the front movable float and the back movable float both connected to the side-wear protective garment, and a securing strap wrapping around the side-wear protective garment, wherein a first connection member is disposed on one end of the securing strap; a second connection member is disposed on the other end of the securing strap; the first connection member and the second connection member are adapted to be joined to each other to enclose the side-opening; a front side and a back side of the side-wear protective garment are connected to the front movable float and the back movable float, respectively, by ropes; and the front movable float and the back movable float are unfoldable to horizontal positions which are their respective extreme positions.

7. The unfolded life jacket as claimed in claim 6, wherein the side-wear protective garment has a plurality of loops horizontally aligned thereon, and the securing strap extends through the loops and wraps around the side-wear protective garment.

8. The unfolded life jacket as claimed in claim 6, wherein a first end of the securing strap is fixed to the side-wear protective garment, and a second end of the securing strap is movable.

9. The unfolded life jacket as claimed in claim 8, wherein the second connection member of the securing strap has a width larger than that of the loops, such that the second connection member of the securing strap is stopped by the loops.

10. The unfolded life jacket as claimed in claim 6, wherein at least one of the ropes is made a turn around the securing strap.

11. The unfolded life jacket as claimed in claim 6, wherein the side-wear protective garment has a plurality of attaching members for attaching the front movable float and the back movable float to the side-wear protective garment.

12. The unfolded life jacket as claimed in claim 6, wherein the fixed float includes a front float and a back float, the opening is located on the front float, and the front float and the back float are connected to the front movable float and the back movable float, respectively.

* * * * *